US010105560B2

(12) United States Patent
Barnick

(10) Patent No.: US 10,105,560 B2
(45) Date of Patent: Oct. 23, 2018

(54) SOLID FOAM STICK MANIFOLD DEVICE

(71) Applicant: Patrick James Barnick, Hartford, SD (US)

(72) Inventor: Patrick James Barnick, Hartford, SD (US)

( * ) Notice: Subject to any disclaimer, the term of this patent is extended or adjusted under 35 U.S.C. 154(b) by 72 days.

(21) Appl. No.: 15/284,641

(22) Filed: Oct. 4, 2016

(65) Prior Publication Data

US 2018/0094759 A1 Apr. 5, 2018

(51) Int. Cl.

| | |
|---|---|
| ***E03B 1/00*** | (2006.01) |
| ***A62C 5/00*** | (2006.01) |
| ***A62C 5/02*** | (2006.01) |
| ***B01F 1/00*** | (2006.01) |
| *A62C 13/22* | (2006.01) |
| *A62C 11/00* | (2006.01) |

(52) U.S. Cl.

CPC ..... *A62C 5/002* (2013.01); *A62C 5/02* (2013.01); *B01F 1/00* (2013.01); *A62C 11/00* (2013.01); *A62C 13/22* (2013.01); *Y10T 137/86187* (2015.04)

(58) Field of Classification Search

CPC ..... A62C 13/22; A62C 5/002; A62C 11/00; B01F 5/0408; B01F 1/00

USPC ..... 137/268, 571; 239/310; 169/6

See application file for complete search history.

(56) References Cited

U.S. PATENT DOCUMENTS

| | | | | | |
|---|---|---|---|---|---|
| 122,244 | A | * | 12/1871 | Gardner | A62C 13/003 169/6 |
| 141,607 | A | * | 8/1873 | Tapley | A62C 13/22 169/18 |
| 504,898 | A | * | 9/1893 | Weidig | A62C 5/002 169/15 |
| 527,120 | A | * | 10/1894 | Macomber | A01C 23/042 137/268 |
| 604,439 | A | * | 5/1898 | Thompson | A62C 5/002 169/15 |
| 623,851 | A | * | 4/1899 | Van Riper | A62C 5/002 169/15 |
| 718,424 | A | * | 1/1903 | Cardella | C02F 3/043 137/126 |
| 1,568,795 | A | * | 1/1926 | Bargar | A62C 13/22 169/84 |
| 1,647,473 | A | * | 11/1927 | Rushmore | B60S 3/044 137/268 |

(Continued)

FOREIGN PATENT DOCUMENTS

| | | |
|---|---|---|
| CN | 103415327 | 11/2013 |
| CN | 103492032 | 1/2014 |

(Continued)

*Primary Examiner* — Umashankar Venkatesan

(57) ABSTRACT

A solid foam stick manifold device provides solid stick foam additive to multiple discharge lines. The device includes a housing having an interior space defining a mixing chamber configured for holding a solid foam stick. An inlet extends from the housing and is in fluid communication with the interior space directly into the mixing chamber. An outlet extends from the housing and is in fluid communication with the interior space. The outlet is positioned such that flow through the inlet passes through the mixing chamber before being expelled through the outlet for expelling foam produced by mixing of water with the solid foam stick within the mixing chamber.

10 Claims, 5 Drawing Sheets

(56) References Cited

U.S. PATENT DOCUMENTS

| | | | | | |
|---|---|---|---|---|---|
| 1,655,722 | A * | 1/1928 | Bedford | A62C 5/002 169/14 |
| 1,781,294 | A * | 11/1930 | McCracken | A62C 5/002 169/15 |
| 1,807,931 | A * | 6/1931 | Purdy | H01B 3/22 106/222 |
| 1,908,141 | A * | 5/1933 | Graaff | A62C 5/002 169/15 |
| 2,989,979 | A * | 6/1961 | Karlson | C02F 1/688 137/268 |
| 3,052,525 | A * | 9/1962 | Vogelmann | B01J 4/02 137/268 |
| 4,276,934 | A | 7/1981 | Fraser | |
| 5,005,601 | A * | 4/1991 | Strong | B01F 5/0496 137/205.5 |
| 5,240,078 | A * | 8/1993 | Worthington | A62C 5/02 169/14 |
| 5,515,924 | A | 5/1996 | Osterhoudt, III | |
| 5,758,725 | A | 6/1998 | Streetman | |
| 6,264,119 | B1 * | 7/2001 | Truong | A61C 1/0076 15/29 |
| 2007/0269497 | A1 | 11/2007 | Alves | |

FOREIGN PATENT DOCUMENTS

| | | |
|---|---|---|
| CN | 204380043 | 6/2015 |
| EP | 0713950 | 5/1996 |

* cited by examiner

SOLID FOAM STICK MANIFOLD DEVICE

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to manifold devices and more particularly pertains to a new manifold device for providing solid stick foam additive to multiple discharge lines.

BRIEF SUMMARY OF THE INVENTION

An embodiment of the disclosure meets the needs presented above by generally comprising a housing having an interior space defining a mixing chamber configured for holding a solid foam stick. An inlet extends from the housing and is in fluid communication with the interior space directly into the mixing chamber. An outlet extends from the housing and is in fluid communication with the interior space. The outlet is positioned such that flow through the inlet passes through the mixing chamber before being expelled through the outlet for expelling foam produced by mixing of water with the solid foam stick within the mixing chamber.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
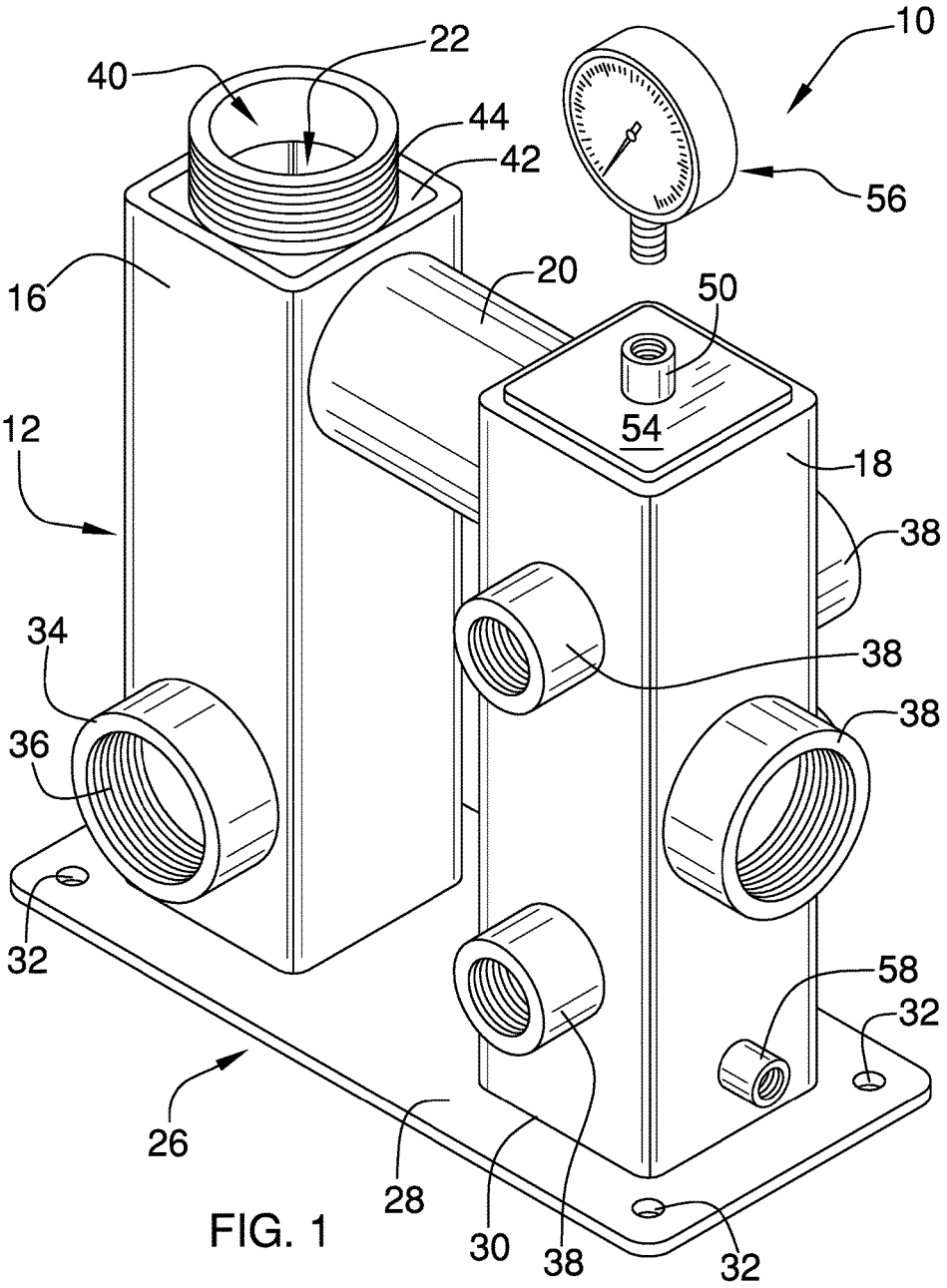
FIG. 1 is a top front side perspective view of a solid foam stick manifold device according to an embodiment of the disclosure.
Figure 2:
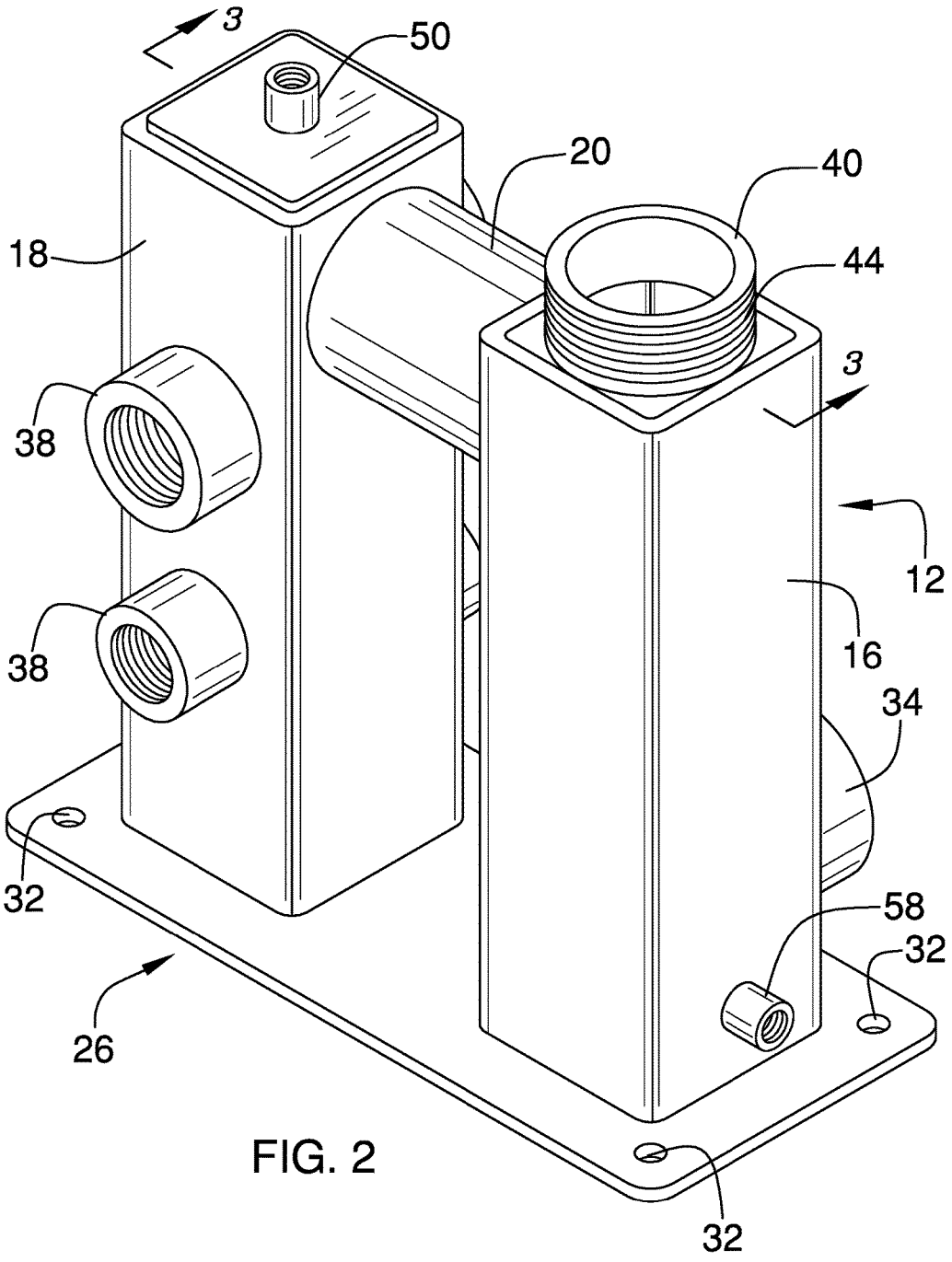
FIG. 2 is a top rear side perspective view of an embodiment of the disclosure.
Figure 3:
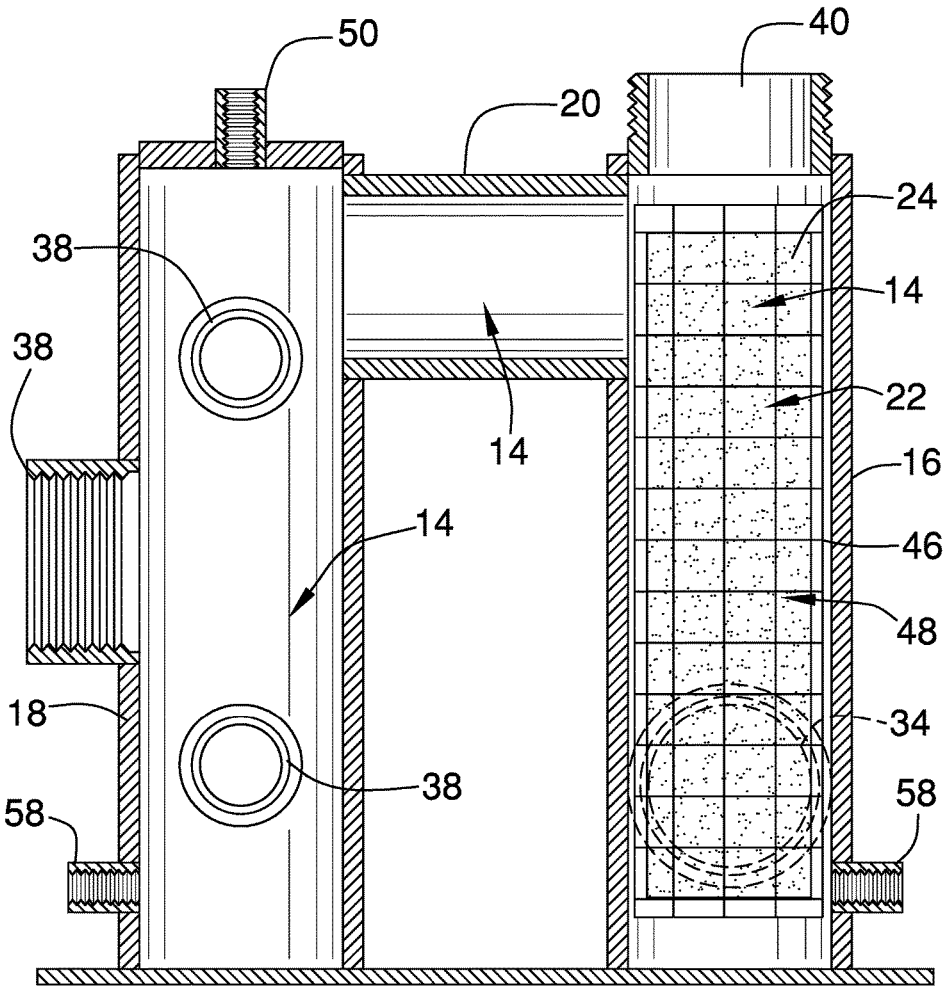
FIG. 3 is a cross-sectional view of an embodiment of the disclosure taken along line 3-3 of FIG. 1.

With reference now to the drawings, and in particular to FIGS. 1 through 5 thereof, a new manifold device embodying the principles and concepts of an embodiment of the disclosure and generally designated by the reference numeral 10 will be described.

As best illustrated in FIGS. 1 through 5, the solid foam stick manifold device 10 generally comprises a housing 12 having an interior space 14. In a first embodiment, the housing 12 has a first vertical section 16 and a second vertical section 18. The first vertical section 16 is laterally spaced apart from the second vertical section 18. The housing 12 includes a conduit 20 extending between the first vertical section 16 and the second vertical section 18. The interior space 14 of the first embodiment defines a mixing chamber 22 within the first vertical section 16 configured for holding a solid foam stick 24. The solid foam stick 24 is of conventional structure and materials as is known and available for purchase to mix with water to produce a fire suppressing foam. A base 26 is coupled to the housing 12. The base 26 defines a planar flange 28 extending outwardly from a bottom peripheral edge 30 of the housing 12. Each of a plurality of connection holes 32 extends through the planar flange 28 wherein the base 26 is configured for securing the housing 12 to a conventional pump unit for dispensing pressurized water as is known for fire fighting applications.

An inlet 34 extends from the housing 12. The inlet 34 is in fluid communication with the interior space 14 directly into the mixing chamber 22. The inlet 34 is positioned proximate the base 26 of the housing 12 and the conduit 20 is vertically spaced above the inlet 34. The inlet 34 is provided with interior threading 36 or the like for coupling an inlet hose of conventional design to the housing 12.

An outlet 38 extends from the housing 12. The outlet 38 is in fluid communication with the interior space 14. The outlet 38 extends from the second vertical section 18 of the housing 12 such that flow through the inlet 34 passes through the mixing chamber 22 before being expelled from the interior space 14 through the outlet 38. Thus, the outlet 38 is configured for expelling foam produced by mixing of water with the solid foam stick 24 within the mixing chamber 22. The outlet 38 is one of a plurality of outlets 38. Each of the plurality of outlets 38 extends from the second vertical section 18 of the housing 12. Each outlet 38 is internally threaded or the like for conventional connection to outlet hoses for dispersing the foam for fire suppression. Each of the outlets 38, if not being actively connected to an outlet hose, may be capped or closed in a conventional manner.

A loading port 40 extends through a top 42 of the housing 12 into the interior space 14 and directly into the mixing chamber 22. The loading port 40 has exterior threading 44 and may be capped when not in use. A basket 46 is shaped to pass through the loading port 40 into the mixing chamber 22. The basket 46 is configured for holding the solid foam stick 24 within the mixing chamber 22 and facilitating removal of a remnant of the solid foam stick 24 from the mixing chamber 22 after use. The basket 46 is structured with openings 48 to allow water to flow freely through the basket 46 to mix with the solid foam stick 24 to produce the foam.

A pressure gauge connector 50 is coupled to the housing 12. The pressure gauge connector 50 is in fluid communication with the interior space 14 and may be positioned on a top surface 54 of the housing 12 over the second vertical section 18. Thus, the pressure gauge connector 50 is configured for securing a pressure gauge 56 to the housing 12 to measure pressure within the interior space 14. A drain hole 58 extends into the housing 12. The drain hole 58 is in fluid communication with the interior space 14. The drain hole 58 is positioned in vertically spaced relationship below the conduit 20. The drain hole 58 is positioned proximate the base 26 of the housing 12. The pressure gauge connector 50 and drain hole 58 may be closed or covered in a conventional manner when not in use.

Figure 4:
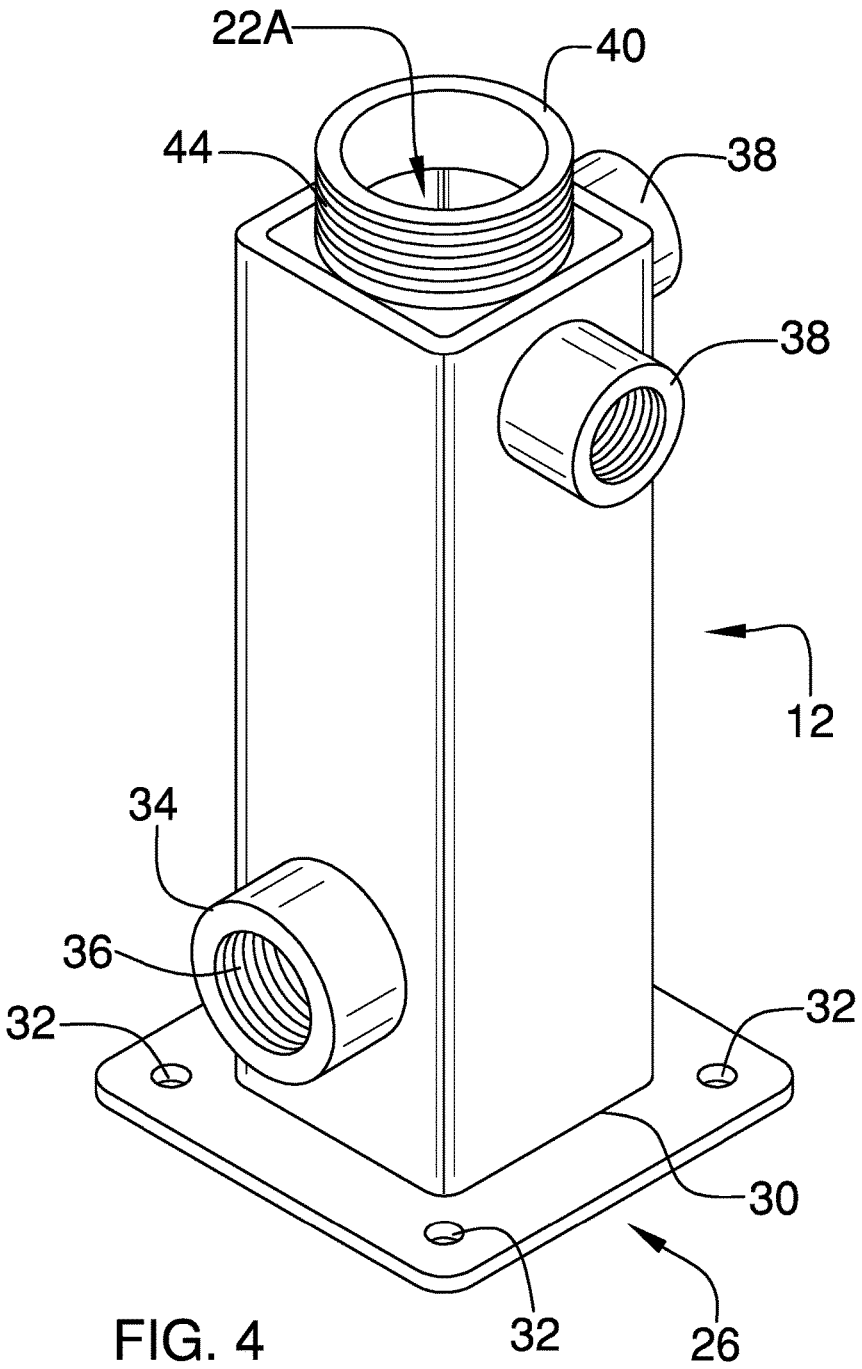
FIG. 4 is a top front side perspective view of an embodiment of the disclosure.
Figure 5:
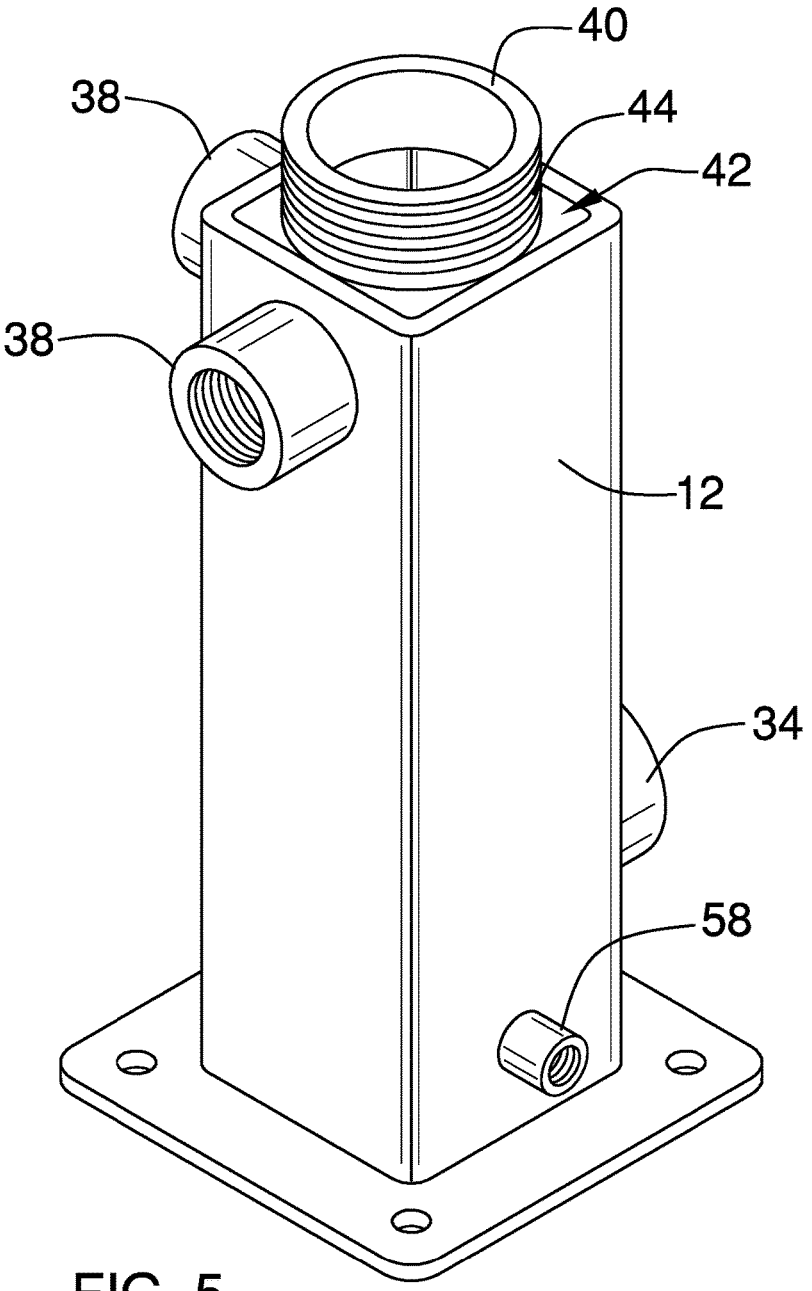
FIG. 5 is a top rear side perspective view of an embodiment of the disclosure.

In a second embodiment as shown in FIG. 4, the housing 12 of the second embodiment is a single parallepiped shape. An entirety of the interior space 14 of the housing 12 of the second embodiment defines a single vertically elongated mixing chamber 22A. The inlet 34 of the second embodiment is positioned proximate to the base 26 of the housing 12 of the second embodiment and the outlet 38 of the second embodiment is positioned proximate to a top 66 of the mixing chamber 22A. The second embodiment provides a smaller footprint but otherwise may incorporate the same elements described above in the first embodiment.

In use, the housing 12 is installed on the pump unit. The inlet hose and desired outlet hoses are attached to the housing 12 as described above. The solid foam stick 24 is placed into the basket 46 and lowered into the mixing chamber 22, 22A through the loading port 40. The housing 12 is then closed by capping the loading port 40 and any other openings described above to produce a flow path through the mixing chamber 22, 22A such that foam is expelled to the outlet hoses.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A solid foam stick manifold device comprising:

a housing having an interior space, said interior space defining a mixing chamber configured for holding a solid foam stick, said housing having a first vertical section and a second vertical section, said first vertical section being laterally spaced apart from said second vertical section, said mixing chamber being defined within said first vertical section, said housing including a conduit, said conduit being straight and perpendicular to said first vertical section and said second vertical section, said conduit extending between said first vertical section and said second vertical section;

a base coupled to said housing, said base extending between said first vertical section and said second vertical section, said base further defining a planar flange extending outwardly from a bottom peripheral edge of said housing;

an inlet extending from said housing, said inlet being in fluid communication with said interior space directly into said mixing chamber; and an outlet extending from said housing, said outlet being in fluid communication with said interior space, said outlet being positioned such that flow through said inlet passes through said mixing chamber before being expelled from said interior space through said outlet wherein said outlet is configured for expelling foam produced by mixing of water with the solid foam stick within said mixing chamber.

2. The device of claim 1, further comprising said conduit being vertically spaced above said inlet into said mixing chamber.

3. The device of claim 1, further comprising a loading port extending through a top of said housing into said interior space and directly into said mixing chamber.

4. The device of claim 3, further comprising a basket, said basket being shaped to pass through said loading port into said mixing chamber, said basket being configured for holding the solid foam stick within said mixing chamber and facilitating removal of a remnant of the solid foam stick from said mixing chamber after use.

5. The device of claim 1, further comprising said outlet extending from said second vertical section of said housing.

6. The device of claim 5, further comprising said outlet being one of a plurality of outlets, each of said plurality of outlets extending from said second vertical section of said housing.

7. The device of claim 1, further comprising a pressure gauge connector coupled to said housing, said pressure gauge connector being in fluid communication with said interior space wherein said pressure gauge connector is configured for securing a pressure gauge to said housing to measure pressure within said interior space.

8. The device of claim 2, further comprising:

said inlet being positioned proximate a base of said housing; and a drain hole extending into said housing, said drain hole being in fluid communication with said interior space, said drain hole being positioned in vertically spaced relationship below said conduit, said drain hole being positioned proximate said base of said housing.

9. The device of claim 1, further comprising a plurality of connection holes extending through said planar flange wherein said base is configured for securing said housing to a pump unit.

10. A solid foam stick manifold device comprising:

a housing having an interior space, said housing having a first vertical section and a second vertical section, said first vertical section being laterally spaced apart from said second vertical section, said housing including a conduit, said conduit being straight and perpendicular to said first vertical section and said second vertical section, said conduit extending between said first vertical section and said second vertical section, said interior space defining a mixing chamber configured for holding a solid foam stick, said mixing chamber being defined within said first vertical section;

a base coupled to said housing, said base defining a planar flange extending outwardly from a bottom peripheral edge of said housing;

a plurality of connection holes extending through said planar flange wherein said base is configured for securing said housing to a pump unit;

an inlet extending from said housing, said inlet being in fluid communication with said interior space directly into said mixing chamber, said inlet being positioned proximate a base of said housing, said conduit being vertically spaced above said inlet into said mixing chamber;

an outlet extending from said housing, said outlet being in fluid communication with said interior space, said outlet extending from said second vertical section of said housing such that flow through said inlet passes through said mixing chamber before being expelled from said interior space through said outlet wherein said outlet is configured for expelling foam produced by mixing of water with the solid foam stick within said mixing chamber, said outlet being one of a plurality of outlets, each of said plurality of outlets extending from said second vertical section of said housing;

a loading port extending through a top of said housing into said interior space and directly into said mixing chamber;

a basket, said basket being shaped to pass through said loading port into said mixing chamber, said basket being configured for holding the solid foam stick within said mixing chamber and facilitating removal of a remnant of the solid foam stick from said mixing chamber after use;

a pressure gauge connector coupled to said housing, said pressure gauge connector being in fluid communication with said interior space wherein said pressure gauge connector is configured for securing a pressure gauge to said housing to measure pressure within said interior space; and a drain hole extending into said housing, said drain hole being in fluid communication with said interior space, said drain hole being positioned in vertically spaced relationship below said conduit, said drain hole being positioned proximate said base of said housing.

* * * * *